US008448411B2

(12) United States Patent
Huber et al.

(10) Patent No.: US 8,448,411 B2
(45) Date of Patent: May 28, 2013

(54) METHOD AND MACHINE TO GROUP AND JOIN ARTICLES

(75) Inventors: Wolfgang Huber, Grafing (DE); Michael Hartl, Raubling (DE)

(73) Assignee: Krones AG, Neutraubling (DE)

( * ) Notice: Subject to any disclaimer, the term of this patent is extended or adjusted under 35 U.S.C. 154(b) by 336 days.

(21) Appl. No.: 12/804,375

(22) Filed: Jul. 20, 2010

(65) Prior Publication Data

US 2011/0016831 A1 Jan. 27, 2011

(30) Foreign Application Priority Data

Jul. 22, 2009 (DE) ..... 10 2009 026 220

(51) Int. Cl.

| | |
|---|---|
| ***B65B 5/06*** | (2006.01) |
| ***B65B 17/02*** | (2006.01) |
| ***B65B 27/04*** | (2006.01) |
| ***B65B 59/02*** | (2006.01) |

(52) U.S. Cl.

USPC ..... 53/398; 53/446; 53/448; 53/449; 53/48.1; 53/543; 53/544; 53/171; 53/202

(58) Field of Classification Search

CPC .. B65B 5/06; B65B 17/02; B65B 27/04; B65B 59/02

USPC ..... 53/398, 446, 448, 449, 48.1, 543, 53/544, 171, 202

IPC ..... B65B 17/02, 27/04, 5/06, 59/02

See application file for complete search history.

(56) References Cited

U.S. PATENT DOCUMENTS

| | | | | | |
|---|---|---|---|---|---|
| 2,069,926 | A | * | 2/1937 | Read | 53/446 |
| 2,956,381 | A | * | 10/1960 | Chauvin et al. | 53/446 |
| 3,212,227 | A | * | 10/1965 | Chidsey, Jr. et al. | 53/543 |
| 3,242,631 | A | * | 3/1966 | Whiteford | 53/398 |
| 3,313,394 | A | * | 4/1967 | Mills et al. | 53/446 |
| 3,332,200 | A | * | 7/1967 | Englander | 53/55 |
| 3,466,834 | A | * | 9/1969 | Standley et al. | 53/448 |
| 3,601,952 | A | * | 8/1971 | Cato | 53/473 |
| 3,895,476 | A | * | 7/1975 | Burns, III | 53/448 |
| 4,036,362 | A | * | 7/1977 | Ullman | 53/398 |
| 4,949,531 | A | | 8/1990 | Langenbeck et al. | 53/534 |
| 4,953,342 | A | | 9/1990 | Hynes | 53/398 |
| 5,241,805 | A | | 9/1993 | Johnson | 53/534 |
| 5,282,348 | A | * | 2/1994 | Dampier et al. | 53/398 |

(Continued)

FOREIGN PATENT DOCUMENTS

| | | |
|---|---|---|
| DE | 26 35 682 A1 | 2/1978 |
| DE | 37 11 766 A1 | 10/1988 |

(Continued)

OTHER PUBLICATIONS

EPO machine translation (4 pages) of DE 26 35 682 A1, Jan. 21, 2011.

*Primary Examiner* — Stephen F Gerrity

(74) *Attorney, Agent, or Firm* — Davidson, Davidson & Kappel, LLC

(57) ABSTRACT

The present invention concerns a method and a machine to group and join at last two articles by attaching a first packaging to form a packaging unit. The individual packaging units are joined together with an additional second packaging to form a bigger unit. The process is carried out continuously, whereby the packaging units are transposed or not.

15 Claims, 6 Drawing Sheets

U.S. PATENT DOCUMENTS

| | | | | | |
|---|---|---|---|---|---|
| 5,359,830 | A | * | 11/1994 | Olson et al. | 53/398 |
| 5,412,923 | A | * | 5/1995 | Lashyro et al. | 53/449 |
| 5,430,992 | A | * | 7/1995 | Olson | 53/446 |
| 5,469,687 | A | | 11/1995 | Olson | 53/48.1 |
| 5,551,212 | A | * | 9/1996 | Odenthal | 53/397 |
| 5,765,336 | A | | 6/1998 | Naegle et al. | 53/201 |
| 5,996,316 | A | * | 12/1999 | Kirschner | 53/202 |

FOREIGN PATENT DOCUMENTS

| | | | | |
|---|---|---|---|---|
| DE | 10 2006 045 292 | A1 | | 4/2008 |
| DE | 10 2007 017 646 | A1 | | 10/2008 |
| EP | 02 78 723 | A2 | | 8/1988 |
| EP | 1431185 | A1 | * | 6/2004 |
| EP | 15 50 610 | A1 | | 7/2005 |
| JP | 2001233378 | A | * | 8/2001 |
| JP | 2003165507 | A | * | 6/2003 |
| JP | 2007161315 | A | * | 6/2007 |
| WO | WO 9914123 | A1 | * | 3/1999 |
| WO | WO 00/46102 | A1 | | 8/2000 |
| WO | WO 2007/112415 | A | * | 10/2007 |
| WO | WO 2008058176 | A1 | * | 5/2008 |
| WO | WO 2009/097546 | A1 | | 8/2009 |

* cited by examiner

METHOD AND MACHINE TO GROUP AND JOIN ARTICLES

This claims the benefit of German Patent Application DE 10 2009 026 220.2, filed Jul. 22, 2009 and hereby incorporated by reference herein.

The present invention concerns a method and a machine to group and join at least two articles by attaching a first packaging means to form a packaging unit, whereby the individual packaging units are joined together with an additional second packaging means to form a bigger unit.

BACKGROUND

Machines and methods for the continuous formation of packs are known. A continuous method is realized for instance in the packaging lines TLM of the company Schubert. This packaging line first forms an inner pack (cluster pack of four) and then packs a plurality of these inner packs to form an outer pack (tray). Hereby clocked working steps are required to unite the articles to an inner pack and to subsequently join them to an outer pack.

The packaging machines often use separate machines located upstream, that—in case of a container flow—place a continuous plastic foil over the containers that is specially adapted to the containers. The combination made out of containers and foil is then formatted or packed as required. The plastic foil is cut at predefined connecting elements. The thereby formed packs are then transferred to another packaging machine where these so called HiCone packs are then further grouped and displaced and get an outer packaging, for instance an underlay in form of a tray or an outer package called wrap-around WO 2000/46102 A1 describes a modular packaging machine. The aim of the described invention is the use of independently controllable single modules, that each has a defined duty in the formation of a package or wrapping. These modules are located in one line and plane. This document only shows the formation of one packaging unit. It does not show the formation of two or more independent packs in this machine.

DE 10 2007 017 646 A1 discloses a modular packaging machine, whereby in each module individual working steps are carried out. The central aspect in this document is the modular design of the machine. No details about the formation of the product are revealed.

DE 10 2006 045 292 A1 shows a machine to pack articles in blister packs. This machine is composed of individual, separable modules. To shorten the time for the production, installation and implementation of the machine it is proposed that each module contains separated drives for the transport and the processing of the blister pack band that can be operated independently of each other.

Furthermore U.S. Pat. No. 5,765,336 A reveals a packaging machine whereby articles coming in a flow are brought together in groups of articles and are placed on so called trays (usually transport packs made out of cardboard). In this way articles can be joined to 6×4-packs and put on the trays. The assembled articles can then be wrapped with a shrinking foil. The machine can have one or two lanes and is realized as a clocked machine.

Different machines are known that form different packs successively. These are usually so called picker lines. These picker lines have the disadvantage that they are clocked machines and that their performance can only be increased by the addition of parallel working steps, for instance more clock lines and steps.

SUMMARY OF THE INVENTION

It is an object of the present invention to provide a method and a machine to group and join articles that allow the production of packs of different size in one machine, whereby the articles are combined to one pack and/or bigger units. The assembly should be carried out continuously.

The invention relates to a method to group and join at least two articles by attaching a first packaging means to form a packaging unit, whereby the individual packaging units are subsequently joined together with an additional second packaging means to form a bigger unit during a continuous conveying movement with or without a transposition of the packaging unit.

The articles can be bottles made out of plastic or glass, cans or the like. In their upper section the articles preferably show a shoulder or a similar enlargement, so that the cross section in this area is at least slightly enlarged compared with the upper side. The packaging units are transported along with a continuous conveying movement. This continuous conveying movement is produced by a horizontally moving conveyor element. The horizontally moving conveyor element can for instance be a feed belt or a conveyor belt on which the articles, packaging units and/or bigger units are moved along continuously through the packaging machine.

Optionally the packaging units can be transposed and then joined by a second packaging means to form a bigger unit. The packaging units are preferably are transposed with respect to their conveying movement, especially they are transposed at an angle of approximately 90° with respect to their conveying movement. This packaging method is versatile and can be used universally to pack and handle a huge variety of articles and packs.

In preparation of the packaging process the articles are isolated into lines on the conveyor belt by an article guiding element. The article guiding element can be made out of leading plates, dividing plates of any kind or something alike that are able to group the incoming articles into single lanes so that the articles are arranged in x lanes and transported further along on the conveyor element. Subsequently the articles are grouped on the conveying element and joined with a first packaging means to a packaging unit while continuously transported further.

During the continuous conveying movement of the articles at least two differently configured packaging units can be produced simultaneously. It is possible for instance to form packs out of 2, 4, 6 and/or 8 articles. It is also possible for the packaging machine to join 9, 12 or 15 articles in a pack. It is possible to produce these different packs subsequently with or without converting the packaging machine. Therefore it is possible to produce two differently configured packaging units with just one configuration of the packaging machine.

A first packaging means serves for the configuration of the packaging units. This first packaging means is also called inner packaging. This first packaging means can be all known packaging means, for instance cardboard clips and/or plastic clips and/or banderols and/or blanks of e.g. plastic foil or prefabricated foil.

As already described above, the first packaging means defines the size of the produced packaging units. For instance the use of a cardboard clip with six gaps or slots leads to the production of a six-pack or a packaging unit made out of six articles. The clip can be made out of cardboard or plastic. The clip is applied on the upper part of the article, for instance around the bottleneck so that the clip rests on the shoulder of the article or bottle. If a banderol is used as first packaging means it is preferably wrapped around the biggest perimeter of the article, for instance it is wrapped around the belly of the bottles. The application of the first packaging means onto the articles is carried out continuously and is preferably synchronised with the conveying movement of the articles.

Prefabricated foil can also be used as first packaging means. Preferably foil with pre cut openings is used. The foil is put of the articles or rather their neck region and can subsequently be cut at predefined places. The plastic foil has elastic properties, therefore the openings enlarge slightly when the foil is put over the articles and afterwards it encloses the articles tightly so that the articles cannot move anymore and/or are under tension. Preferably the first packaging means is secured against slipping by the enlargement of the articles in their upper region as described above. The plastic foil is preferably an endless foil provided on a roll that is unwound during the packaging of the articles. During the packaging process the foil roll can for instance be located above the articles.

To separate an arbitrary amount of articles in packaging units any known cutting device can be used. Preferably at least two articles are joined in a packaging unit by a first packaging means in form of a foil. A cutting device usually comprises at least one rotating cutting blade for instance a cutting disc with at least two separating means or blades.

The cardboard clips, plastic clips or the other blanks are preferably taken out of at least one storage depot by a robot arm in a robot station. The robot station can preferably be a jointed arm robot with vacuum suction heads or the like. Subsequently the removed first packaging means is applied onto the articles. During the application of the first packaging means the articles are transported continuously in a specified conveying velocity on the conveying element.

After the articles are joined together by the first packaging means to form a packaging unit, a second packaging means is used to produce bigger units of these packaging units. For instance a six-pack of articles is produced by the application of the first packaging means. Four of these six-packs are then joined by the second packaging means to form a pack out of 24 articles. The second packaging means is preferably a carton, shrinking foil or the like. With a described outer packaging out of shrinking foil and/or a pad and/or a packaging blank a bigger unit can be produced.

The articles that are joined by the first packaging means to a packaging unit are further transported along the transport direction. For the production of bigger units out of the packaging units there are different possibilities. One possibility is to slide the packaging units onto a tray. The tray, pad or an alike blank is usually taken out of a depot and slit onto the transport belt from below. At the same time the packaging units are deposited onto this second packaging means. As already described above it can be advantageous that the small packaging units produced first are transposed before they are joined to bigger units. For instance the smaller packaging units can be rotated about an angle of circa 90° relative to the transportation direction. This can optionally be carried out by an arm with a gripper, a so called pusher, a suitable turntable in the course of a horizontal conveyance or by another suitable means or facility. For the production of the bigger units several packs can be enveloped by a shrinking foil to form the bigger unit.

The present invention describes a method and a packaging machine for the implementation of the described method, that allow the production of packaging units with a first and a second packaging means in a continuous process. The packaging machine serves to group and join at least two articles by attaching a first packaging means to form a packaging unit, and to join the individual packaging units with an additional second packaging means to form a bigger unit along an uninterrupted conveyor device.

The uninterrupted conveyor device can be a continuously moving transport belt, a conveyor belt or something alike. The articles stand on this belt and are transported with a conveying velocity along the band in the conveying direction. The uninterrupted conveyor device forms a product flow in one plane. Additionally the packaging machine is a machine working continuously. If in this context we speak of an uninterrupted conveyor device, it also comprises conveyor devices that ensure an almost uninterrupted article flow. In the course of the article flow the packaging units can be rotated if required to get them in a favorable position for the packaging of the bigger units. This variant also constitutes a continuous conveyance flow of articles and/or packaging units because this optional rotation does not need to lead to an interruption of the article flow.

The articles can be joined and converted into a specified, common format of packaging units, for instance 1×2 packs, 1×3 packs, 2×2 packs, 2×3 packs, n×m packs and so on. The process is independent from the required format or the container size. The conversion to another format or to another container size can take place following a new instruction by a suitable controlling device. The instruction can define a new width adjustment and/or a conversion of defined parameters in the control program of the controlling device.

Because of the continuous process in a product line the floor space requirement of such a packaging machine is significantly reduced compared to known packaging machines. Also the processes are better adjustable because between the machines or the single modules respectively there are almost no accumulation lines, buffering lines and/or packaging unit transport lines. The continuous flow path also leads to a higher total efficiency.

BRIEF DESCRIPTION OF THE DRAWINGS

The exemplary embodiments in the following passages, with the aid of the attached figures, are intended to explain in detail the invention and its advantages. The size ratios of the individual elements in the figures do not necessarily reflect the real size ratios. It is to be understood that in some instances various aspects of the invention may be shown exaggerated or enlarged to facilitate an understanding of the invention.

DETAILED DESCRIPTION

Figure 1:
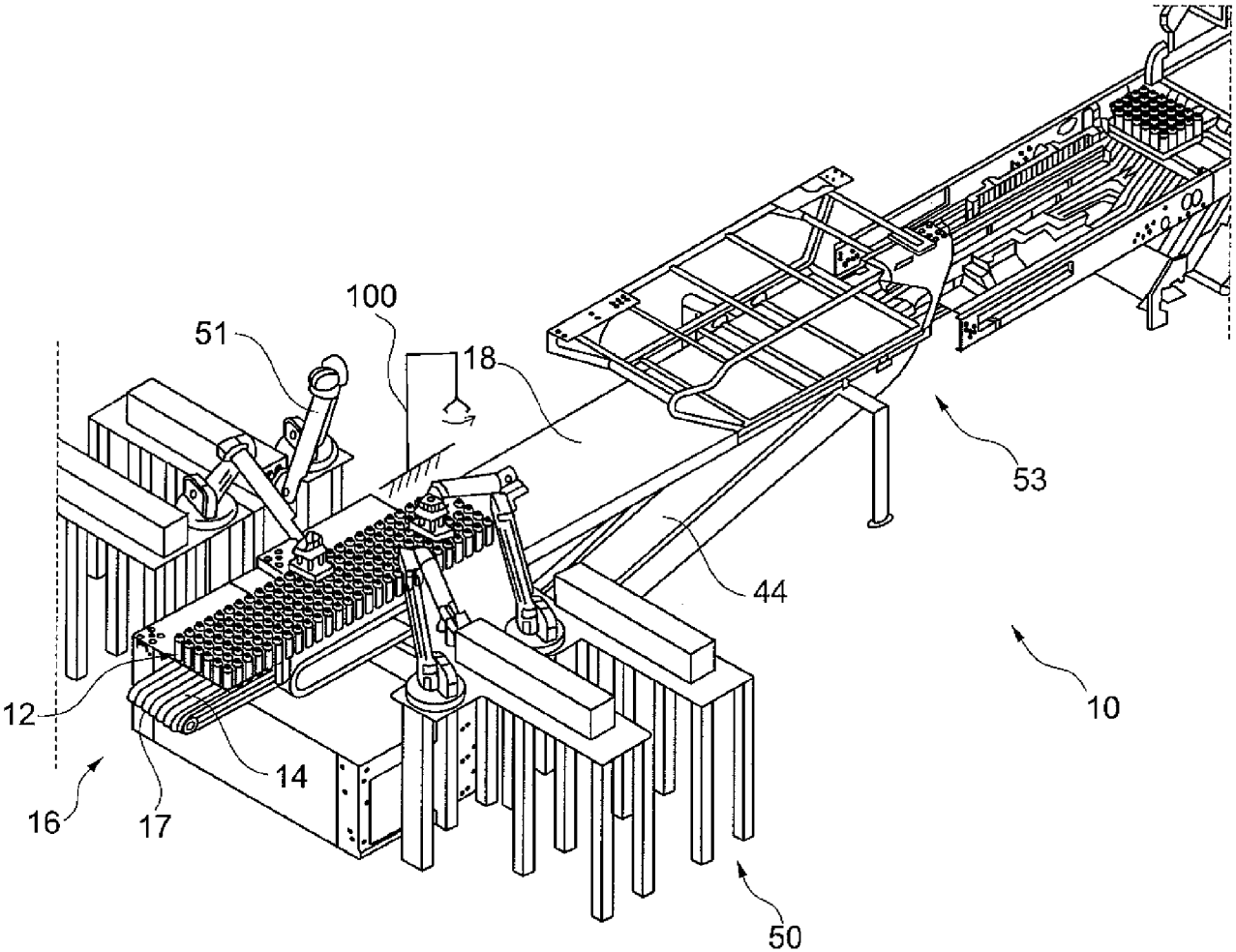
FIG. 1 shows a first embodiment of a packaging machine to group and join articles.

The same or equivalent elements of the invention are designated by identical reference characters. For the sake of clarity, only the reference characters relevant for describing the respective figure are provided. It should be understood that the embodiments described are only examples of designing the bodies, the packages, the device, or the method according to the invention, and they are not intended to limit the scope of the disclosure.

The schematic representation of FIG. 1 shows an embodiment of a packaging machine 10 for grouping and joining of articles 12. The articles 12 to be packed are guided into appropriate lanes 16 with the help of an article guiding element. The article guiding element can for instance be a transport belt arranged before the single lanes 16. With the help of lane plates 14 the articles 12 are arranges in rows and transported along a transport belt 18 through the packaging machine 10. The embodiment shown contains six rows to guide the articles 12.

The packaging machine 10 can be separated into several different working sections, whereby the articles 12 are usually not transposed. As soon as the articles 12 are guided into the lanes 16, the articles move towards a robot station 50. There the first packaging means 20 (see FIG. 2) is applied onto the articles 12 by at least one jointed arm robot 51. The shown embodiment contains four jointed arm robots 51, which combine the incoming articles 12 arranged in rows with a first packaging means 20 to a packaging unit 22 (see FIG. 2). The first packaging means 20 therefore serves to form one or more packaging units 22, whereby several packaging units 22 can be formed simultaneously.

The packaging units 22 formed by this method are then handed over to a pushing device 53. Optionally, a transposition device 100, shown schematically as an arm with a gripper, can rotate the packaging units 90° before being handed over. In this pushing device 53 the packaging units 22 are joined to form bigger packaging units 26 (see FIG. 5). For the combination of the packaging units 22 to bigger packaging units 26 a second packaging means 40 (see FIG. 5) is required. In the pushing device 53 the packaging units 22 can be covered by a shrinking foil 46 (see FIG. 6) and/or the bigger packaging units 26 are pushed onto a tray 42 (see FIG. 5). The tray 42 can for instance be moved from a conveying device 44 from below up to a transport belt 18. Also the shrinking foil 46 or something the like can be transported up from below and cover the packaging units 26. This machine is not shown because it is already known state of the art. In the pushing device 53 the packaging units 22 are joined to bigger packaging units 26 of desired size and form independently of the constructive details of the machine and independently of process details. Therefore the packaging machine 10 can be used to group different article formations to packaging units 22.

Figure 2:
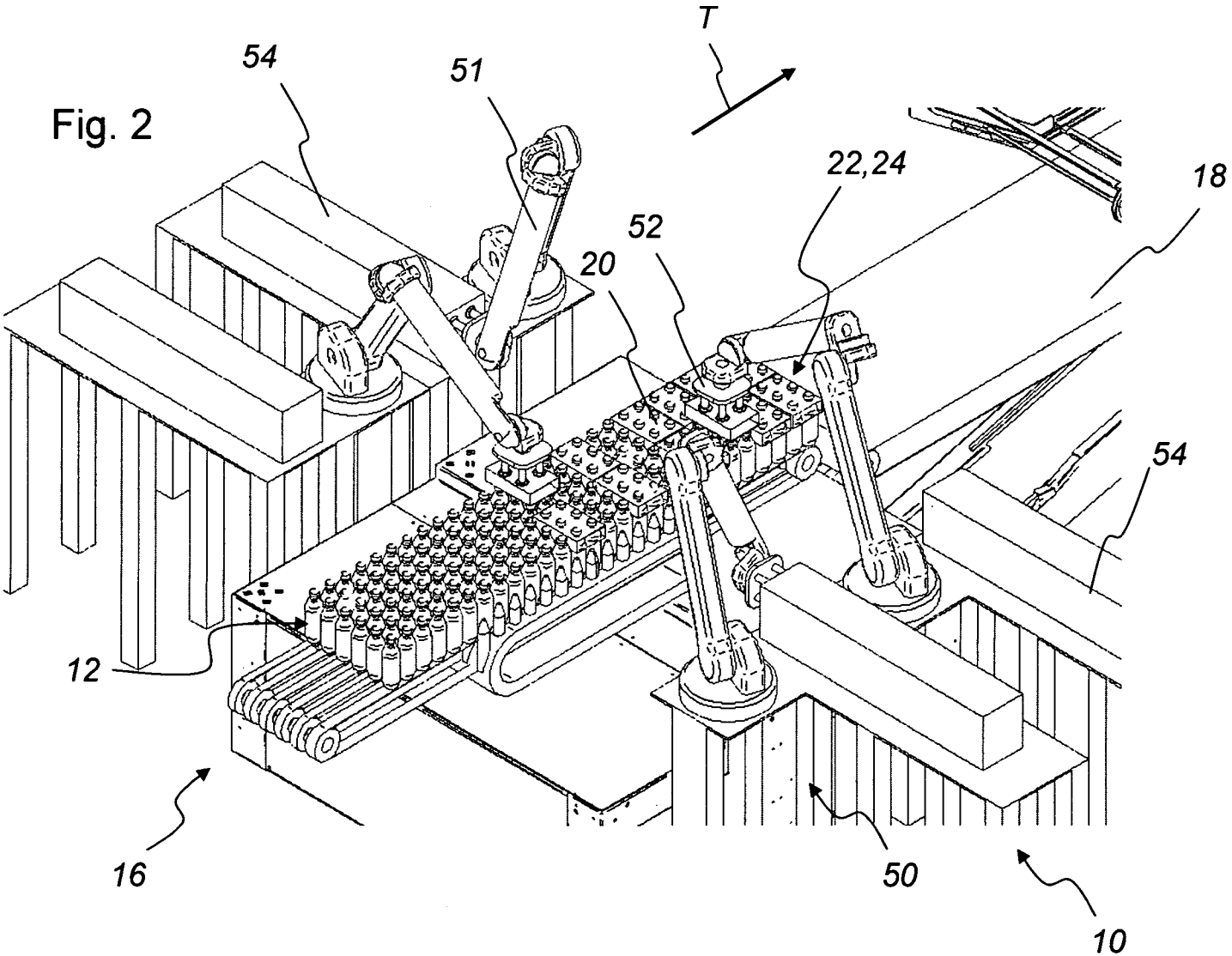
FIG. 2 shows an enlarged section of the packaging machine to group and join articles by a first packaging means from FIG. 1.

The enlarged section of FIG. 2 shows details of the packaging machine 10 for grouping and joining of articles 12 from FIG. 1. The articles 12 to be packed are guided into appropriate lanes 16 with the help of an article guiding element 14 (see FIG. 3) or elements of equal function. The combination of the articles 12 with the first packaging means 20 is performed in a robot station 50 by a jointed arm robot 51. As first packaging means 20 a plastic clip 28 or a cardboard clip 30 (see FIG. 4) or something alike can be used. The four jointed arm robots 51 shown in FIG. 2 take the respective first packaging means 20 out of a depot 54 at different times and cover the articles 12 with the first packaging means 20. The jointed arm robots 51 each comprise a vacuum suction head 52 that takes the first packaging means 20 out of the depot 54. Depending on the required performance the number of jointed arm robots 51 in a packaging machine 10 can be upgraded or reduced.

The first packaging means 20 also determines the size of the packaging units 22 to be formed. Meanwhile the articles 12 are joined to packaging units 22 the articles or the packaging units 22 continuously move along the transport belt 18 in the transport direction T with an almost constant conveying velocity, so that the formed packaging units 22 or so called packs 24 can be combined to bigger units 26 (see FIG. 5 or FIG. 6). The combination of several packaging units 22 to a bigger unit 26 occurs with the help of a second packaging means 40 (see FIG. 5 or FIG. 6). In this context it should be mentioned again that the articles 12 move along the transport belt 18 with a continuous conveying velocity in transport direction T while the first packaging means 40 is applied.

Figure 3:
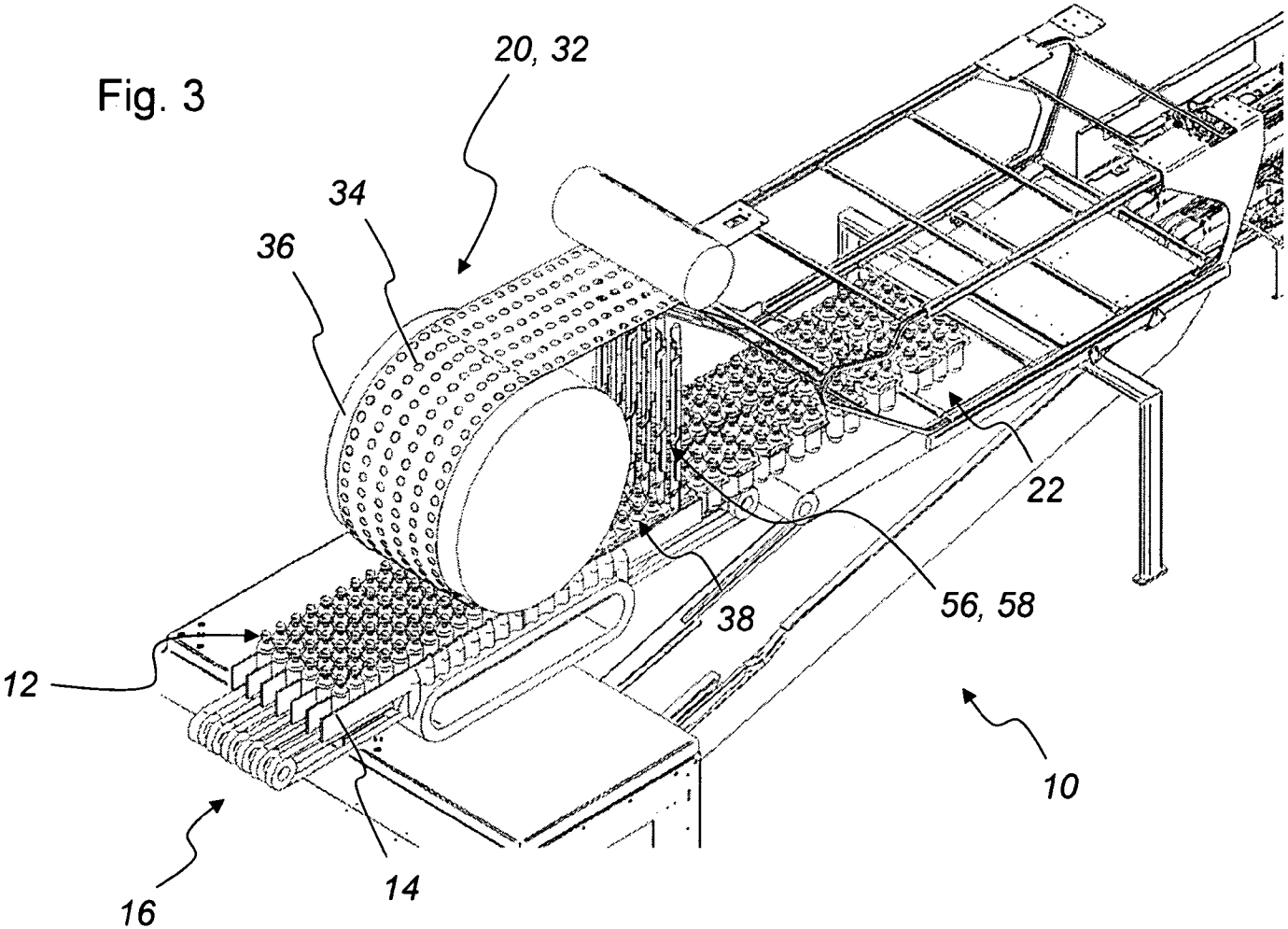
FIG. 3 shows another embodiment of the packaging machine to group and join articles by a first packaging means.

The schematic representation of FIG. 3 shows another embodiment of a packaging machine 10 for applying a first packaging means 20 onto articles 12. Also in this embodiment the articles 12 to be packed are guided into appropriate lanes 16 with the help of article guiding elements 14, so that the articles 12 can be joined to packaging units 22 (see FIG. 4) by the application of a first packaging means 20. Hereby a pre-configured foil 32 that contains pre-cut openings 34 is put over the articles 12 and cut afterwards at defined positions (not shown). The plastic foil has elastic properties. Therefore the pre-cut openings 34 are slightly enlarged when put over the articles. Afterwards they fit tightly onto the articles 12 or sit on the articles 12 with a slight tension without slipping. The bottle necks 60 (see FIG. 4) point upwards through the pre-cut openings 34.

The pre-configured foil 32 can for instance be removed from a supply (not shown) and guided over a roll 36. The roll 36 comprises the necessary techniques to put the foil 32 over the articles 12 to form an article-foil-composite 38 to begin with. Subsequently the foil 32 is cut with a cutting device 56. The cutting device 56 can contain several cutting blades 58 arranged beside each other that are not further explained here. By cutting the article-foil-composite 38 with the help of the cutting device 56 packaging units 22 of desired size and form are formed.

Figure 4:
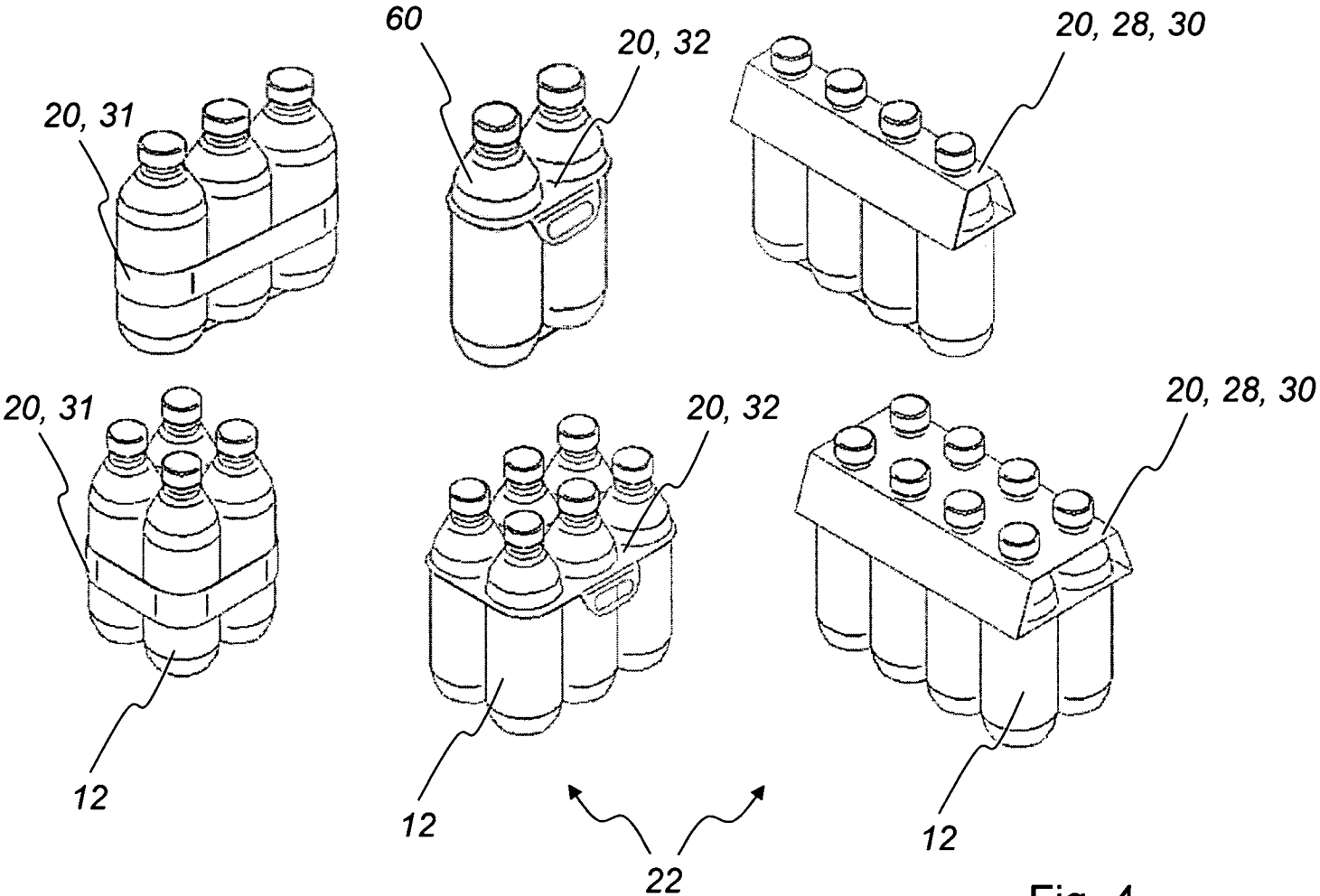
FIG. 4 shows several articles that are joined together by the first packaging means to form a packaging unit.

The representation of FIG. 4 shows several articles 12 that are joined by a first packaging means 20 to a packaging unit 22. Several variants of differently sized and formed packaging units 22 are shown. The articles 12 of the packaging units 22 shown on the left comprise a banderol 31. The banderol 31 keeps the single articles 12 together in the packaging unit 22. In the shown embodiment either three articles 12 or four articles 12 are joined with a banderol 31 to form a packaging unit 22. The articles 12 of the packaging unit 22 shown in the middle are kept together by a pre-configured foil. The formation of such a packaging unit 22 is already described in reference to FIG. 3. The articles 12 of the packaging unit 22 shown on the right are kept together by a clip 28, 30 out of plastic or cardboard.

Figure 5:
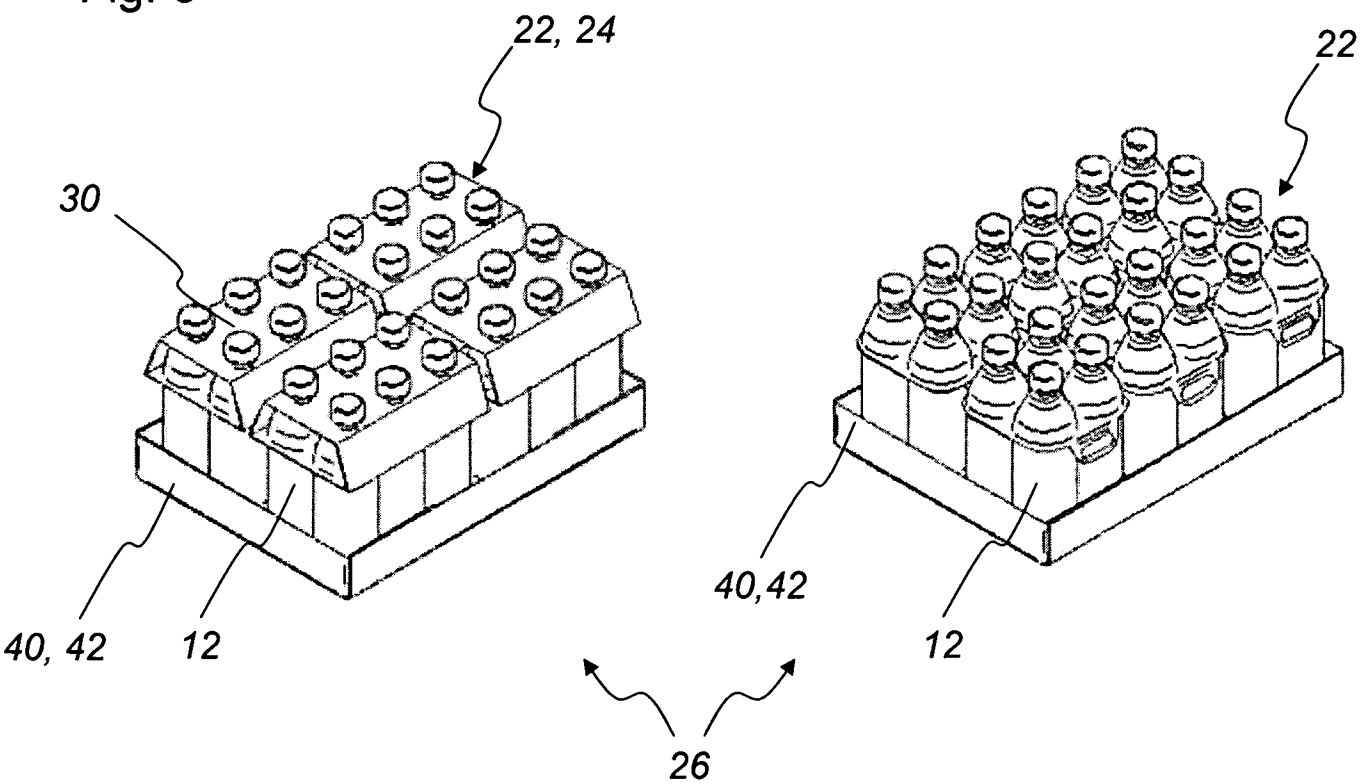
FIG. 5 shows packaging units that are joined together to bigger units by a second packaging means.

The representation of FIG. 5 shows packaging units 22 that are joined to a bigger unit 26 by a second packaging means 40. The packaging machine 10 (see FIG. 1 and FIG. 2) enables for instance the formation of a bigger unit 26 or a tray of twenty four out of four packaging units 22 or four packs 24 with six articles 12 each (see illustration depicted on the left of FIG. 5).

As shown in the illustration depicted on the right of FIG. 5 instead of cardboard clips 30 a pre-configured foil 32 (so called "HiCones") can be used. These packaging units 22 are formed by a machine shown in FIG. 3. These packaging units 22 can also be joined to a bigger unit 26, whereby they are pushed onto a tray 42 by the packaging machine 10.

Figure 6:
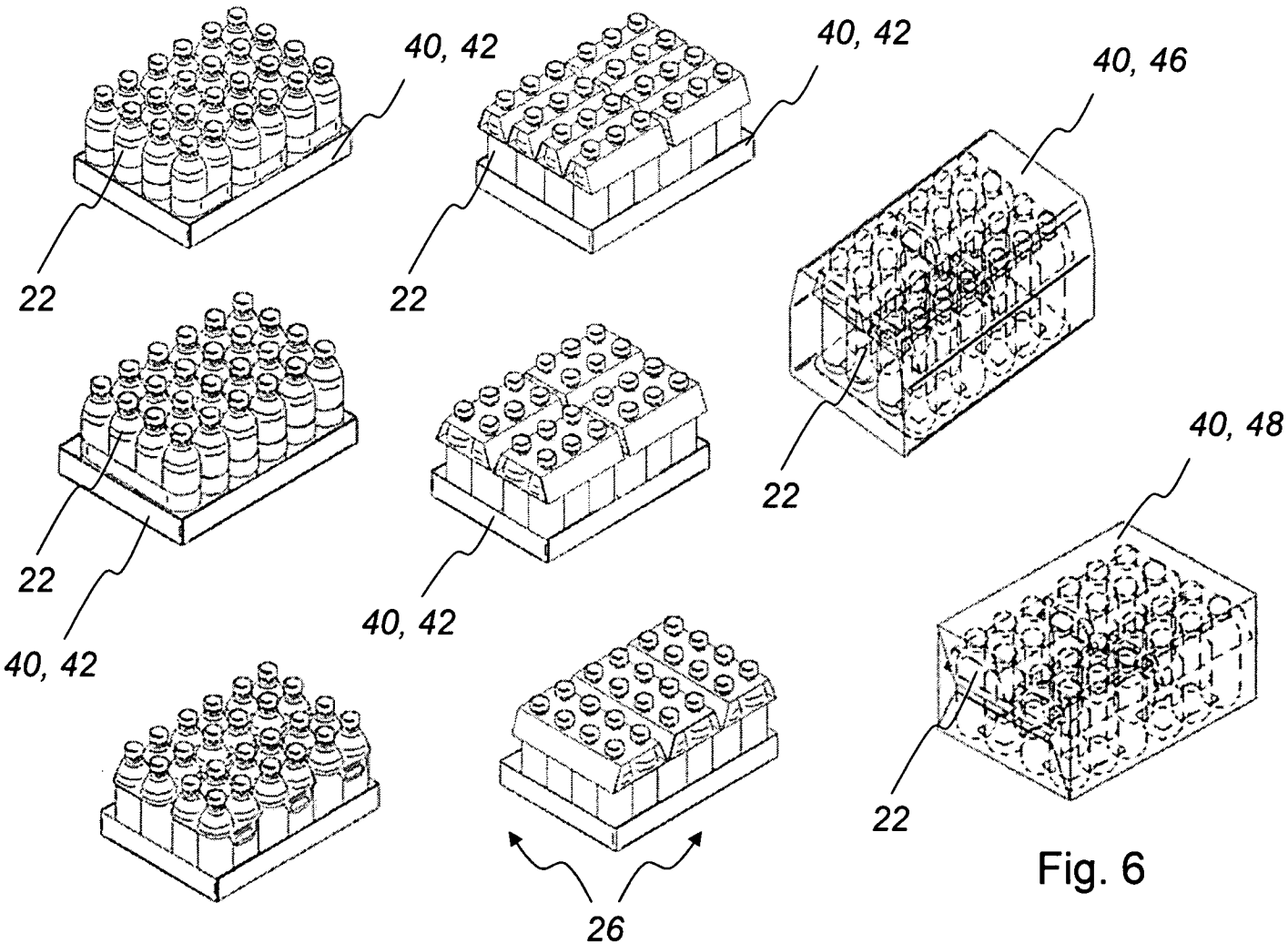
FIG. 6 shows other embodiments of bigger units.

FIG. 6 shows further embodiments of bigger packaging units 26. Both left rows of the bigger packaging units 26 are formed by a tray 42. Both illustrations on the right show bigger packaging units 26 that are formed by the application of a shrinking foil (upper illustration) or a carton 48 (lower illustration). Each illustration of FIG. 6 clearly shows how the individual packaging units 22 are joined to bigger packaging units 26 by a second packaging means 40.

The invention has been described with reference to preferred embodiments. To the expert it is also conceivable, however, to make changes and modifications without leaving the scope of protection of the appended claims.

LIST OF REFERENCE CHARACTERS

10 packaging machine
12 Article
14 lane plate
16 Lane
18 transport belt
20 first packaging means
22 packaging unit
24 Packs
26 bigger unit
28 plastic clip
30 cardboard clip
31 Banderol
32 Foil
34 pre-cut opening
36 Roll
38 article-foil-composite
40 second packaging means
42 Tray
44 conveying device
46 shrinking foil
48 Carton
50 robot station
51 jointed arm robot
52 vacuum-suction head
53 pushing device
54 Depot
56 cutting device
58 cutting blade
T transport direction

What is claimed is:

1. A method for grouping and joining at least two articles comprising:

attaching first packaging to the articles to form individual packaging units; and joining together the individual packaging units with an additional second packaging to form a bigger unit during a continuous conveying movement with or without a transposition of the packaging units; wherein at least two differently configured packaging units are formed simultaneously or are formed successively without conversion of the packaging machine.

2. The method as recited in claim 1 wherein the continuous conveying movement is generated by a horizontally moving conveyor.

3. The method as recited in claim 1 wherein the articles, packaging units and bigger units are each moved continuously.

4. The method as recited in claim 1 wherein the packaging units are transposed and then joined by the second packaging to form the bigger unit.

5. The method as recited in claim 4 wherein the packaging units are transposed at an angle of approximately 90° with respect to their conveying movement.

6. The method as recited in claim 1 wherein the transported articles and the packaging units formed thereof are moved and joined to the bigger units in one plane.

7. The method as recited in claim 1 wherein the at least two differently configured packaging units are formed simultaneously.

8. The method as recited in claim 1 wherein the at least two differently configured packaging units are formed successively without conversion of the packaging machine.

9. The method as recited in claim 1 wherein the first packaging means is a cardboard clip and/or a plastic clip and/or a banderol and/or a blank.

10. The method as recited in claim 1 wherein the second packaging is a transport packaging made out of cardboard and/or shrinking foil and/or a packaging blank.

11. A packaging machine to group and join at least two articles comprising: an uninterrupted conveyor device; a first device to attach first packaging to form individual packaging units along the uninterrupted conveyor device; and a second device to join the individual packaging units with an additional second packaging to form a bigger unit along the uninterrupted conveyor device; wherein the first device forms at least two differently configured packaging units simultaneously or successively without conversion of the packaging machine.

12. The packaging machine as recited in claim 11 wherein the uninterrupted conveyor device is a continuously moving transport belt.

13. The packaging machine as recited in claim 11 wherein the uninterrupted conveyor device forms a product flow in one plane.

14. The packaging machine as recited in claim 11 wherein the packaging machine is a continuously working machine.

15. The packaging machine as recited in claim 11 further comprising a transposition device for rotation of the packaging units around an angle of about 90° compared to the original conveying movement, the transposition device being located between the first device, the first device being a grouping station for the formation of the packaging units, and the second device where the individual packaging units are joined to bigger units.

* * * * *